US006290168B1

(12) United States Patent
Elger

(10) Patent No.: US 6,290,168 B1
(45) Date of Patent: Sep. 18, 2001

(54) REEL WINDING DEVICE AND PROCESS OF WINDING

(75) Inventor: Hanspeter Elger, Mülheim (DE)

(73) Assignees: Stora Publication Paper AG, Dusseldorf; Voith Sulzer Papiertechnik Patent GmbH, Germany and Heidenheim, both of (DE)

( * ) Notice: Subject to any disclaimer, the term of this patent is extended or adjusted under 35 U.S.C. 154(b) by 0 days.

(21) Appl. No.: 09/433,923

(22) Filed: Nov. 4, 1999

(30) Foreign Application Priority Data

Nov. 5, 1998 (DE) ..... 198 51 023

(51) Int. Cl.[7] ..... B65H 18/14; B65H 18/26

(52) U.S. Cl. ..... 242/541.5; 242/530.4; 242/533.3; 242/542.4

(58) Field of Search ..... 242/541.5, 541.4, 242/541.6, 542, 542.4, 542.3, 530, 530.1, 530.4, 533.2, 533.3

(56) References Cited

U.S. PATENT DOCUMENTS

| | | | | |
|---|---|---|---|---|
| 3,086,726 | | 4/1963 | Aaron . | |
| 3,869,095 | * | 3/1975 | Diltz . | |
| 4,508,283 | * | 4/1985 | Beisswanger . | |
| 4,541,585 | * | 9/1985 | Frye et al. . | |
| 4,601,435 | * | 7/1986 | Tomma et al. . | |
| 4,697,755 | | 10/1987 | Kataoka . | |
| 4,749,140 | * | 6/1988 | Ruff . | |
| 5,806,783 | * | 9/1998 | Turunen | 242/530.1 |
| 5,820,063 | * | 10/1998 | Fissman et al. | 242/530.4 |
| 5,853,139 | * | 12/1998 | Hehner et al. | 242/530.1 |
| 5,938,144 | * | 8/1999 | Kaipf et al. | 242/530.4 |
| 6,056,230 | * | 5/2000 | Peters et al. | 242/541.5 |
| 6,109,559 | * | 8/2000 | Dorfel et al. | 242/533.2 |
| 6,149,098 | * | 11/2000 | Kuhn et al. | 242/530.4 |

FOREIGN PATENT DOCUMENTS

| | | |
|---|---|---|
| 2724955 | 12/1978 | (DE) . |
| 3243994 | 5/1984 | (DE) . |
| 3832601 | 12/1989 | (DE) . |
| 4302345 | 8/1994 | (DE) . |

* cited by examiner

*Primary Examiner*—William A. Rivera
(74) *Attorney, Agent, or Firm*—Greenblum & Bernstein, P.L.C.

(57) ABSTRACT

A reel winding device comprising a center drum, and a winder drum arrangement. The center drum and the winder drum define at least one winding bed. At least one winding roll is received in the at least one winding bed. The winder drum arrangement has a support body for each winding roll. The support body has front sides with predetermined extensions at its axial ends, thus leaving a free working space. The working space is provided to permit a roll core mechanism to be driven into place.

41 Claims, 3 Drawing Sheets

REEL WINDING DEVICE AND PROCESS OF WINDING

CROSS-REFERENCE TO RELATED APPLICATIONS

The present application claims priority under 35 U.S.C. § 119 of German Patent Application No. 198 51 023.3, filed on Nov. 5, 1998, the disclosure of which is expressly incorporated by reference herein in its entirety.

BACKGROUND OF THE INVENTION

1. Field of the Invention

The present invention relates to a reel winding device having at least one winding bed to accommodate at least one winding roll which is formed by a center drum and a winder drum arrangement.

The invention disclosed herein is described in connection with winding a paper web onto a winding roll without, however, being limited to this particular application.

2. Discussion of Background Information

In one of the final paper manufacturing steps, paper webs are cut to a width suitable for a consumer, such as a printing plant, and then wound into winding rolls. Generally, a winding tube, made of cardboard or another material of limited stability, is employed as a roll core. The paper web is fastened onto the roll core. The paper web is then drawn onto the circumference of the roll core, thereby forming the winding roll by rotating the roll core or the winding roll being formed thereon.

The winding process must be precisely controlled, especially in the case of larger rolls. It is desirable that the winding roll be wound as tightly as possible. Particularly, the winding tightness should be as great as possible at the beginning of the winding process, i.e., when the winding roll is first being formed. The winding tightness may, however, diminish towards the outside of the winding roll.

In reel winding devices, so-called winder drum coilers are sometimes situated in a winding bed that is formed by two winding drums with at least one of the two winding drums being driven. When employing winding drum coilers, however, there is no support for the winding roll initially, e.g., at the roll core.

Another embodiment is designated as a so-called center drum winder. In this case, the winding roll is adjacent to a center drum, and the winding roll is supported laterally by a winder drum if necessary. Generally, several winding rolls, which are situated alternatingly on either side of the central drum with a corresponding gap, are wound simultaneously. A roll core holding device can be situated within the space located on the front side of the rolls so that, with the increasing roll diameter and an associated increase in weight, the winding roll can be supported at the roll core. This eases the weight in the nips between the winding roll and the center drum or the winder drum.

Allowing a pressure roller to act on the winding roll in order to achieve the greatest possible tightness at the beginning of the winding process is also known in connection with this. The force of the pressure roller is reduced during the course of winding and is ultimately eliminated at a predetermined diameter.

SUMMARY OF THE INVENTION

The invention disclosed herein provides further possibilities for increasing the winding tightness during the winding process.

This is accomplished, in a reel winding device of the type described in the introduction, with a winder drum arrangement that has a support body for each winding roll of an axial length that corresponds to that of the winding roll, and which has front sides with a predetermined extension at its axial ends, leaving a working space free in which a roll core mechanism can be inserted.

Based on the roll core mechanism described herein, the winding roll may be driven by means of the driven center drums, via a driven winder drum situated at its circumference, or it may be driven at the roll core. This permits the tension of the material web to be wound, such as a paper web, to be increased, which is important especially at the beginning of the winding process in order to achieve the greatest possible winding tightness. A roll core mechanism of this type could not be used until now because there was no space for it. In the heretofore known reel winding machines, the winding roll dips relatively low into the winding bed, at the initial stages of the winding process, due to its small diameter so that a holding device but not a mechanism could be accommodated, if necessary, on its front side. Due to the use of support bodies, however, whose width corresponds to the axial extension of the winding roll, support for the winding roll can now be provided along its entire length, which is important particularly at a later stage of winding when the winding roll has a large diameter and is therefore heavier. In the present invention there exists adequate space to accommodate the roll core mechanism at the beginning of winding. Further, where several winding rolls are wound on one side of the center drum, there is a support body for every winding roll. The support bodies on one side are arranged at intervals from one another that are adequate for accommodating the roll core mechanisms. Naturally, a corresponding winder drum arrangement made up of one or more support bodies can also be located on the other side of the center drum. The only limitation that exists in this case is that the width of the winding roll creating the "gap" must be sufficiently large to accommodate two roll core mechanisms. Generally, however, this can be achieved. If narrower winding rolls are required, the roll core mechanisms can be positioned at the axial ends of the reel winding device.

It is preferred for the support bodies to be formed by a stack of discs that are connected to one another in a detachable manner. This embodiment is particularly advantageous in cases where the cutting schemes change, i. e., when winding rolls of various widths are required. In this case, it is not necessary to keep a support body in stock and mount it for every roll, thereby keeping investment and labor costs low. The desired roll width can henceforth be obtained by putting different discs together laterally.

It is preferred for this purpose that all discs in a stack have essentially the same axial length except for a compensating disc if necessary. Therefore, only one type of disc is generally needed, which simplifies stock keeping and spare parts procurement. In individual cases, compensating discs may be necessary in order to keep the difference between the axial length of the stack and the winding roll from becoming too large. One can manage with discs of a single thickness since one does not want to continuously change the roll widths, but use predetermined graduations. Another advantage of the subdivision of the support body into discs is that it facilitates testing of different roll coatings on individual segments or discs which is more cost effective than it would be on wide winder drums. In addition, it is easier to employ more extravagant roll coatings on narrower sections than on wider winder drums.

In an especially preferred embodiment, every disc has an inflatable coating. The coating can be formed of rubber or another elastomer, thus reducing the load of the winding roll in the nip between the winding roll and the winder drum.

The support body is preferably arranged on a continuous shaft running along an axial length of the center drum. As a result, no large structural changes are required to use this invention with conventional center drum winders. With the exception of the thinner shaft, the support body operates essentially the same as a conventional winder drum.

The support body is preferably connected to the shaft so that it has torsional strength when the shaft is driven. This permits a drive mechanism, or an additional drive mechanism, if need be, of the winding rolls, to be utilized in the same manner as known center drum winders. In this case, however, the support body mechanism can be arranged relatively far towards the outside, i. e., outside the axial extension of the center drum, so that it does not interfere during winding.

It is preferred that the support body be adjustable along the axis of the shaft. As a result, it is possible to situate the support body at different locations along the winding roll, which is favorable when there are changes in the cutting scheme.

Preferably, the support body consists of at least one disc whose radial thickness is at least as great as the height of a winding head that carries the roll core mechanism. In this embodiment, the shaft can remain relatively thick, and the working space is determined by the radial thickness of the disc or discs. Under certain circumstances, the disc can be subdivided axially into more than one disc.

It is also preferred that the disc be clamped permanently on the shaft. The disc can then be shifted into the desired position and, as a result of the permanent clamping, is permanently connected to the shaft in the axial direction so that it has torsional strength. Permanent clamping does not require any complicated connection techniques, e.g., a form closure using a tongue and groove connection or a spline connection.

The winder drum arrangement is supported, against the force of gravity, from below by a support device. As a result of the changing diameter, the same overall mechanical stability is not present across the axial extension of the winder drum arrangement that corresponds to the axial extension of the center drum. In particular, there is a danger that "thinner" shafts will sag when the adjacent support body is stressed, but a support device can counteract this sagging. The support device can be applied to the shaft between two support bodies. It can also act directly on a support body, however.

It is preferred in this connection for the support device to be adjustable in the axial direction. It can then be used, as required, with alternating cutting schemes. It is further preferred for the support device to be located within the gap between two support bodies, wherein the winding head or heads are also situated. In this manner, the overall height of the winder drum arrangement can be kept to a minimum.

It is also advantageous if the support body is situated on a moveable carriage arrangement. This facilitates a high degree of flexibility. The support body can be moved to the desired positions with the aid of the movable carriage arrangement and be fastened there.

The movable carriage arrangement may also include a support body mechanism. This is an alternative to having all support bodies on one side being driven by a common shaft. If a dedicated support body mechanism is employed, a continuous shaft is no longer required and a greater amount of working space is thus available.

It is further preferred that every disc on the movable carriage arrangement to have its own carriage. The individual discs are comparatively light and can thus be handled relatively easily with one carriage. To form a support body, several discs must be positioned next to one another and, if necessary, connected to one another.

Additionally, the support body can be moved over a roll outflow table. Therefore, the support body can be removed from the center drum making it easier to eject the winding roll, particularly when dealing with relatively small rolls.

It is further advantageous to be able to adjust the height of the roll core mechanism. The center point or the rotational axis of the support body can then remain stationary. Thus, when the diameter increases, the roll core mechanism can migrate upwardly.

Provisions can be made in an alternative embodiment for the roll core mechanism to be stationary over a portion of the winding process and for the support body to have a pressing device. With this embodiment, the pressure force at the beginning of the winding process, which is an additional factor for generating winding tightness, is formed by pressing the support body on the winding roll being formed. The pressure can then be eased as the winding roll diameter increases.

A pressure roll arrangement acts on the winding roll, which has a plurality of pressure rollers arranged in succession in the axial direction that are individually adjustable in relation to a common carrier. This embodiment allows for the pressure rollers to not penetrate into the working space, thus, leaving it open for the roll core mechanism. Only those pressure rollers that are located above one of the winding rolls to be wound are engaged, i.e., extended downwardly. The others, which are located axially outside the winding roll, remain on the carrier so that roll core mechanism can be situated there.

In accordance with the invention, a reel winding device comprises a center drum, and a winder drum arrangement. The center drum and the winder drum define at least one winding bed. At least one winding roll is received in the at least one winding bed. The winder drum arrangement has a support body for each winding roll. The support body has front sides with predetermined extensions at its axial ends, thus leaving a free working space. The working space is provided to permit a roll core mechanism to be driven into place.

The reel winding device disclosed also includes a support device for supporting the winder drum arrangement against gravitational forces.

In addition, the support body has an axial length approximately equal to that of a corresponding winding roll. Further, the support body includes at least one disc which may comprise a stack of discs which are connected to one another in a detachable manner.

In the reel winding device disclosed herein, the discs have substantially the same axial length with at least one disc of a radial thickness which is at least as great as the height of a winding head that carries the roll core mechanism. A compensating disc may also be employed.

The support body is additionally arranged along a shaft running parallel to an axial length of the center drum, and it is also connected to the shaft, which can be driven, in order to give it torsional strength. Further, the support body is adjustable axially along the shaft, and the support device is adjustable in the axial direction.

The reel winding device disclosed herein, also includes an adjustment mechanism for adjusting the height of the roll core mechanism. Additionally, each disc can include an inflatable coating.

Also, the roll core mechanism can be stationary during a portion of the winding process. The support body may also include a pressure roll arrangement which comprises a plurality of pressure rollers arranged in succession in the axial direction and which are individually adjustable in relation to a common carrier.

The reel winding can also include at least one movable carriage arrangement with the support body being carried on the movable carriage arrangement. The at least one movable carriage arrangement can also include a dedicated support roller mechanism. In addition, the one movable carriage arrangement comprises a separate movable carriage arrangement associated with each disc.

The reel winding device disclosed herein can also include a roll outflow table, where the support body is movable over the roll outflow table.

In accordance with the invention, a reel winding device comprises a center drum, and a winder drum arrangement. The center drum and the winder drum define at least one winding bed. At least one winding roll is received in the at least one winding bed. The winder drum arrangement has a support body for each winding roll, the support body comprising at least one disc and being arranged along a driven shaft running parallel to an axial length of the center drum. The support body has front sides with predetermined extensions at its axial ends, thus leaving a free working space. The support body further includes a pressure roll arrangement, with the pressure roll arrangement made up of a plurality of pressure rollers arranged in succession in the axial direction and individually adjustable in relation to a common carrier. The working space is provided to permit a roll core mechanism to be driven into place. A support device supports the winder drum arrangement against gravitational forces, and an adjustment mechanism is provided for adjusting the height of the roll core mechanism.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
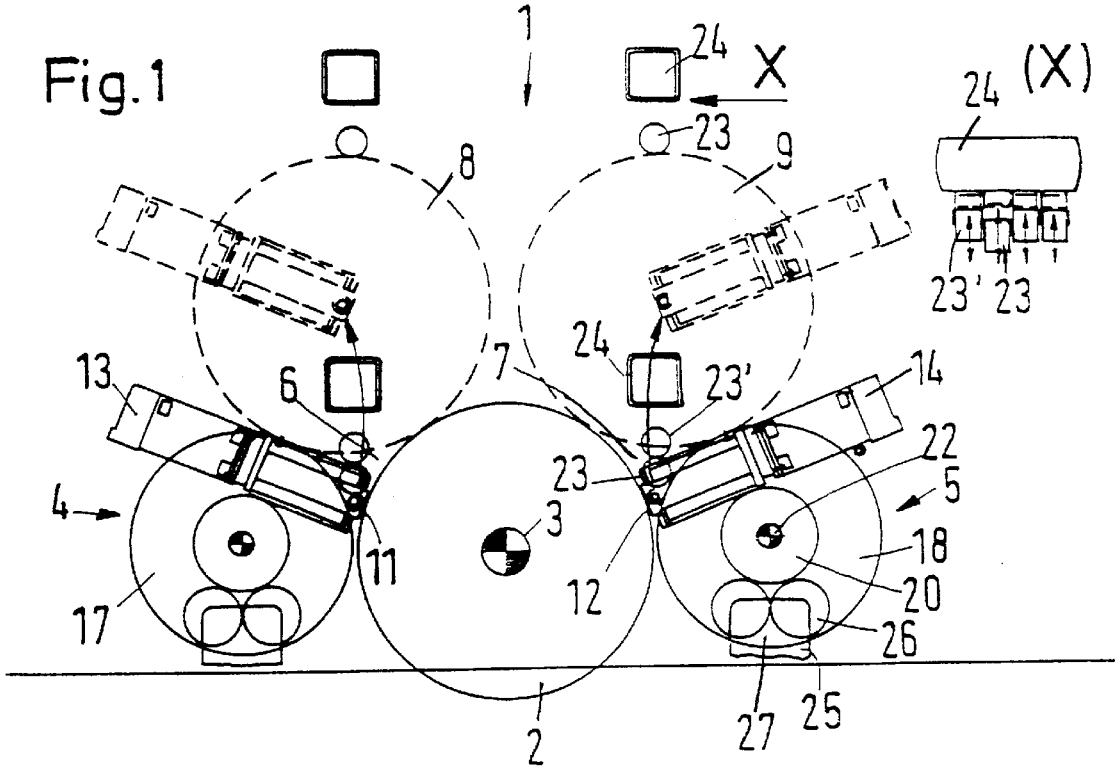
FIG. 1 is a front view of a first embodiment of a reel winding device.
Figure 2:
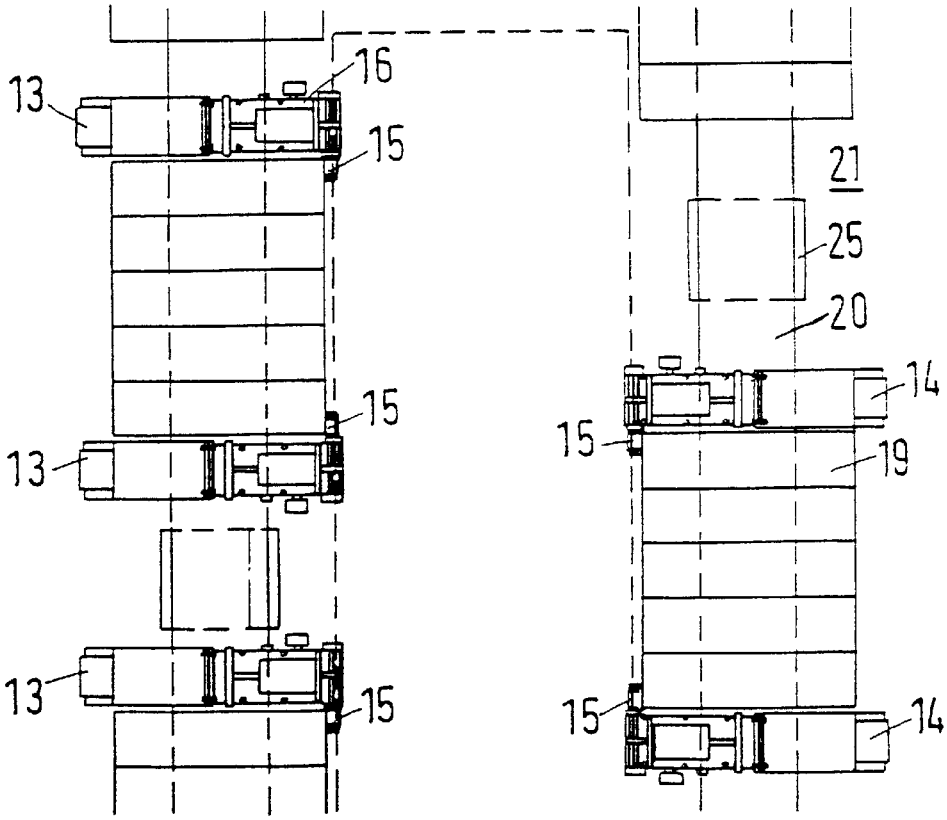
FIG. 2 is a top view of the reel winding device shown in FIG. 1.

A reel winding device 1 as shown in FIGS. 1 and 2 has a centrally attached center drum 2 with a driving mechanism 3. A winder drum arrangement 4, 5 is located on both the left side and the right side. These arrangements form a winding bed 6, 7 with the center drum 2. Winding rolls 8, 9 are located in the winding beds 6, 7. These are depicted by dotted lines in FIG. 1 with a diameter that corresponds approximately to the final diameter of the completed winding roll.

Figure 3:
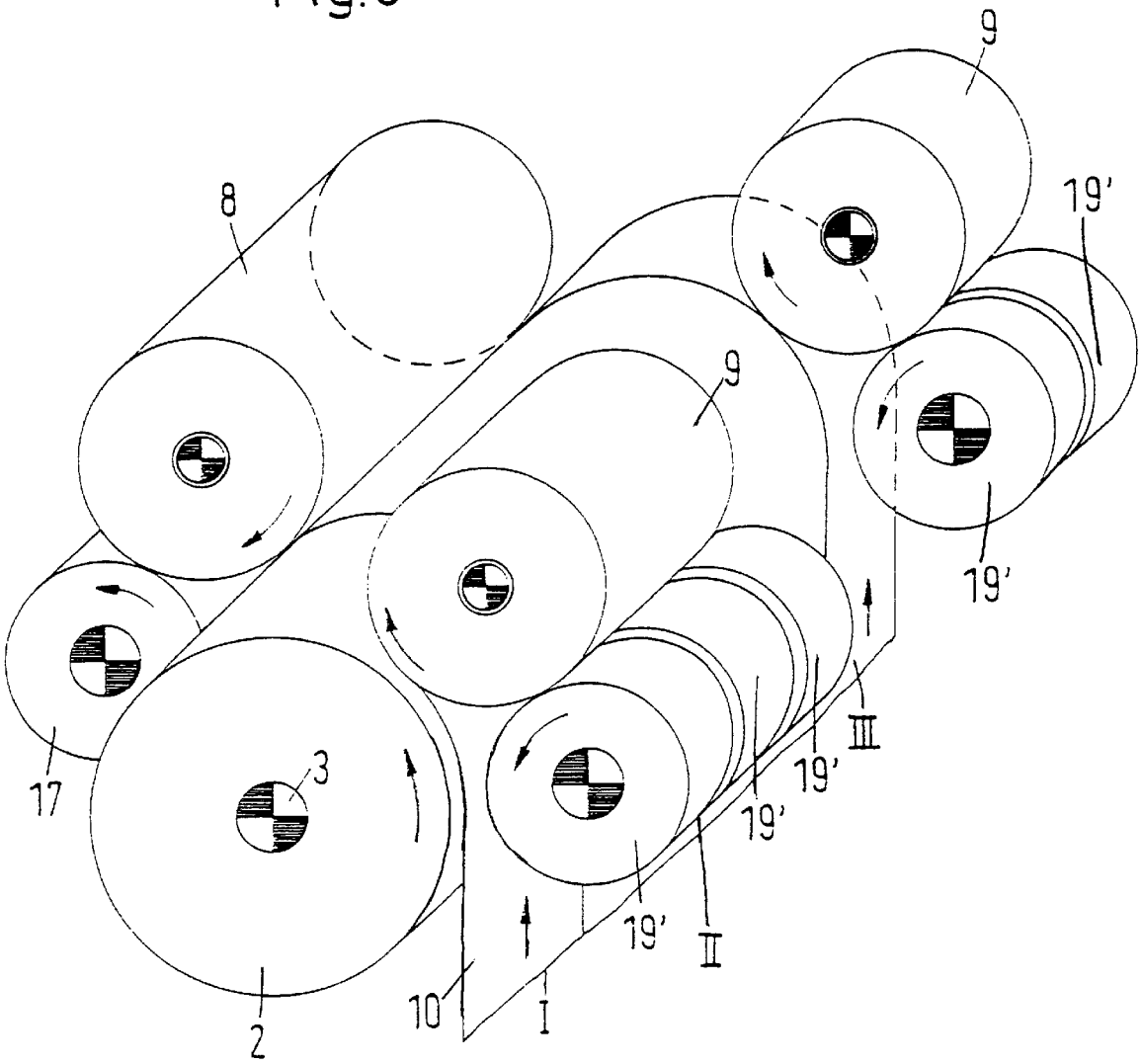
FIG. 3 is a perspective representation of another reel winding device.

The winding rolls 8, 9 are formed by a material web 10, which is not shown in more detail in FIGS. 1 and 2 but can be seen in FIG. 3, cut into various strips I, II, III and being wound onto roll cores 11, 12. To produce the winding rolls, the paper web 10 is fastened to the roll cores 11, 12, and the roll cores 11, 12 are set into rotation in a manner that is not described in detail but is known per se.

The individual winding rolls 8, 9 are arranged adjacent to one another on a gap and the individual strips of the material web 10 are guided respectively into the winding bed 6 and the winding bed 7. Consequently, there is always a gap between the adjacent winding rolls 8, 9 in one winding bed 6, 7 which corresponds to the width of the respective winding roll 8, 9 in the other winding bed 7, 6.

The roll cores 11, 12 are driven by a roll core mechanism 13, 14. As can be seen in FIG. 2, a roll core mechanism 13, 14 can be located at the front side of each respective winding roll 8, 9. Every roll core mechanism 13, 14 has a peg 15 which can be driven into place in the roll core 11, 12 and fastened there, and a motor 16 which drives the peg 15. In addition, the peg 15 can accommodate a portion of the weight of the winding roll 8, 9, which is of significance if the winding roll 8, 9 has a large diameter and is thus considerably heavier. Such an arrangement can reduce somewhat the load pressure on the center drum 2.

A further measure for reducing the load pressure consists of supporting the winding roll 8, 9 at the corresponding winder drum arrangement 4, 5, in addition to supporting it at the center drum 2.

Until now, this support has resulted in no space being available for the roll core mechanisms 13, 14. This problem is now alleviated in the case of the embodiment of the reel winding device 1 according to FIGS. 1 and 2 in that the winder drum arrangements 4, 5 are no longer formed by one continuous winder drum along the entire axial length of the reel winding device. On the contrary, each winder drum arrangement is composed of at least one support body 17, 18 whose axial length is dictated by the axial length of the winding roll 8, 9 to be wound. In order to be able to accomplish this, each support body 17, 18 is composed of several discs 19 put together in the form of a lateral stack which are connected to one another in a detachable manner. Specifically, the discs 19 can be adjusted on the shaft 20 in the axial direction, i.e., parallel to the rotational axis of the center drum 2. They can be clamped permanently on the shaft 20 using a clamping device that is not described in greater detail here. The axial length of the support body 17,

18 can be changed by adding a disc 19 to or removing one from the support body 17, 18.

The diameter of the shaft 20 is still relatively large, but it is considerably smaller than the diameter of the discs 19. Consequently, a working space 21 is available at the ends of the support body 17, 18 wherein the roll core mechanism 13, 14 can be situated. The radial extension of the discs 19, i.e., their radial thickness, is selected in such a way that it is at least just as large as the height of the roll core mechanisms 13, 14. The roll core mechanisms 13, 14, can be lowered far enough that they can also hold and primarily drive the roll cores 11, 12 when these are in the deepest portion of the "gap" between the center drum 2 and the support bodies 17, 18, i.e., when they are in the initial stages of winding.

As mentioned above, the discs 19 are clamped permanently on the shaft 20. If the shaft 20 also has a driving mechanism 22, a total of three driving mechanisms act on the winding roll 8, 9 or the roll core 12: the driving mechanism 3 of the center drum 2; the roll core driving mechanism 13, 14; and the driving mechanism 22 of the shaft 20. With this embodiment, it is possible to exert considerable tensile stress on the paper web early in the winding process and therefore tightly winding the winding roll 8,9. In this respect, the roll core mechanism 13, 14 has a greater effect on the winding tightness than the two other mechanisms.

As the diameter of the winding roll 8, 9 increases, the roll core mechanism 13, 14 migrates upward on a stay not described in more detail here. The purpose of the roll core mechanism 13, 14, shifting during the process from a driving function to a holding function is to ease the weight on the support of the winding roll 8, 9.

In addition, a pressure roller 23 can act on the roll core 11, 12 from above during the initial winding phase. The pressure roll 23 is fastened to a carrier 24. As can be seen in detail in view "X," a series of pressure rollers 23 are arranged in succession in the axial direction and can be lowered individually. In FIG. 1, one pressure roller 23' is shown in the non-lowered position. This pressure roller 23' is located outside the axial extension of the roll core 12. It is evident from this representation that the pressure rolls 23, 23' also do not impinge the working space 21 of the roll core mechanisms 13, 14. Consequently, there is still enough space to hold and drive the roll cores 11, 12.

The discs 19 can all have the same axial extension. Provisions, however, can also be made for a compensating disc, with a reduced axial extension, to be located at the axial end of each support body 17, 18.

Since the shaft 20 has a reduced diameter as compared to a customary winder drum, the danger exists that the shaft 20 will sag. This is counteracted by a support device 25, which has two support rollers 25 in a carrier 27. The carrier 27 and therefore the support rollers 25 can be adjusted in the axial direction. Thus, with a changing cutting scheme, they may be adjusted to correspond to the respective working spaces 21. Since they are arranged beneath the shaft 20, the carrier 27 and support rolls 25 do not interfere with the roll core mechanisms 13, 14. The carrier 27 can also be adjusted perpendicularly to the shaft 20. This is recommended so the discs 19 can be adjusted axially along the shaft 20 without interference.

The discs 19 of a winder drum arrangement 4, 5 are each situated along a common axis on a shaft 20 in the embodiment according to FIGS. 1 and 2. Another approach, however, is used in the embodiment according to FIGS. 3 through 5 wherein the same parts have the same reference numbers, but wherein certain reference numbers have been omitted.

It is evident that the size of the support bodies 17, 18 may be adjusted by using a varying number of discs 19'. These support bodies 17, 18 are depicted in FIGS. 3 and 4 with a small axial distance between the discs 18' which is generally eliminated in practice, however.

In addition, FIG. 3 illustrates an arrangement in which the width of the paper web 10 is varied, and wherein: paper web strip I is wound in the right winding bed 7; paper web strip II is wound in the left winding bed 6 (winding roll 8); and paper web strip III is again wound in the right winding bed 7. Consequently, there is working space available in the right winding bed 7 whose axial length corresponds to the axial length of the winding roll 8.

Figure 4:
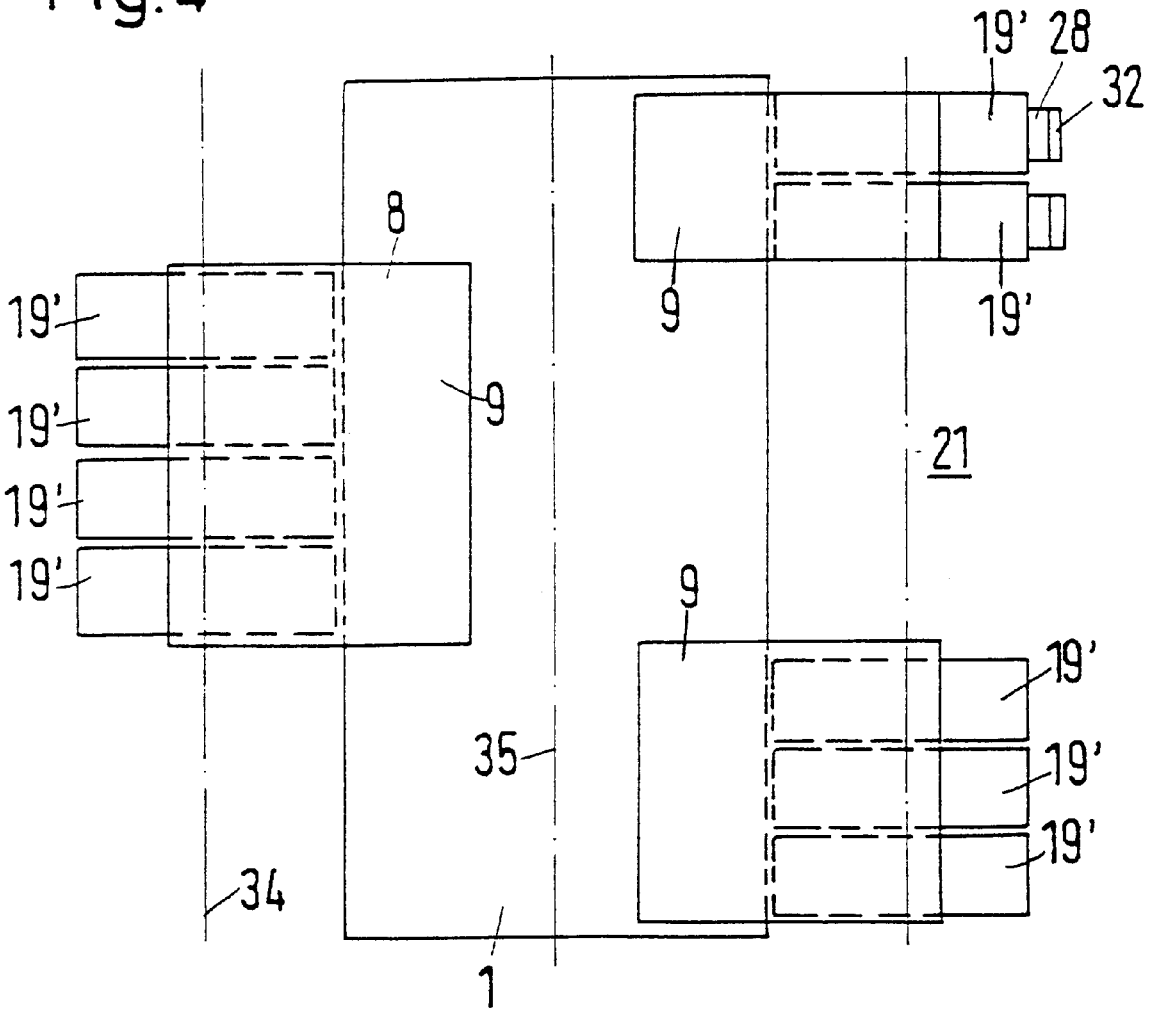
FIG. 4 is a schematic top view of the reel winding device shown in FIG. 3.

The holding devices for the roll core mechanisms are not represented in FIGS. 3 and 4. All mechanisms are simply indicated by a circle with two diametrically opposed black quarters.

Figure 5:
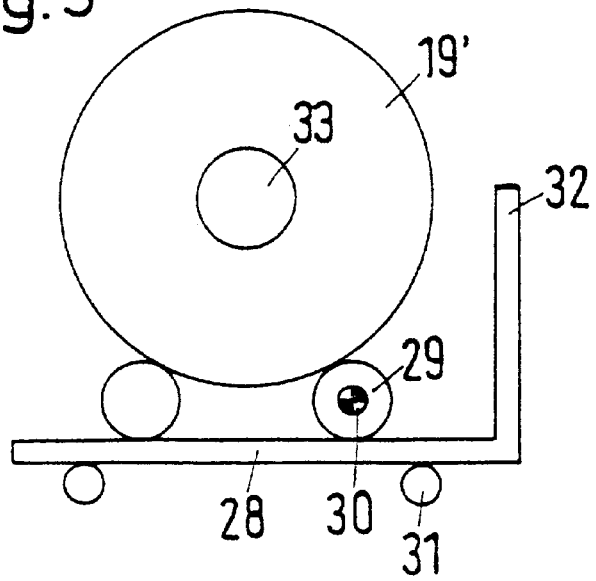
FIG. 5 is a schematic representation of a movable carriage arrangement with a disc and a support body.

As FIG. 5 shows, the individual discs 19', including support rollers 29 with driving mechanisms 30, may be stored on wagons or carriages 28. The carriage 28 is on wheels 31 so that it can be driven into the desired position with the aid of a handle 32. The individual discs 19' have a centered opening 33 so that they may be connect with one another coaxially.

It is evident from FIG. 4 that the winding rolls 8, 9 are not required to be precisely the width of the stack of the discs 19'. On the contrary, the winding rolls 8, 9 can be somewhat wider. Their widths will only be the same, as shown for the upper winding roll 9, in exceptional cases (the carriages 28 of the discs 19' are shown only for these winding rolls).

Fastening several carriages 28 adjacent to each other in an axial direction is facilitated by the opening 33 in the discs 19'. In addition, measures that are not described in more detail herein, but are known per se may be employed in order to align the carriages 28 on the floor or on a machine base in such a way that the rotational axis 34 of the discs 19' runs parallel to the rotational axis 35 of the center drum 2.

Figure 6:
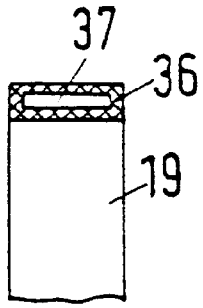
FIG. 6 is a cross-section through a part of the disc.

Along with the adjustability of the axial length of the individual support bodies to the winding rolls 8, 9, segmenting the support bodies into individual discs has the advantage that one is able to test different roll coatings on the discs or segments more easily and therefore more cost effectively than on wide winder drums. In addition, it is easier to cover individual discs with more extravagant roll coatings than wide winder drums. Thus, FIG. 6 depicts a disc 19 with a coating 36 that is formed of rubber and a hollow space 37 which can be subjected to pressure. This is an inflatable coating that can be used to further reduce the nip load.

Naturally, other elastomer plastics can be used instead of rubber. When using this type of coating 36, the axial gaps between the individual discs that are shown in FIGS. 3 and 4 can also be maintained. These axial gaps, however, can be eliminated when the coating 36 is pressed together.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A reel winding device comprising:

a center drum;

a winder drum arrangement;

said center drum and said winder drum arrangement defining at least one winding bed;

at least one winding reel received in said at least one winding bed, wherein a wound roll is to be formed on said at least one winding reel;

a roll core mechanism coupled to each at least one winding reel;

the winder drum arrangement comprises support bodies in which at least one support body is provided for each at least one winding reel, and said support bodies in said at least one winding bed are arranged to be axially spaced from each other to form a working space;

the working space being provided to permit insertion of said roll core mechanism.

2. The reel winding device recited in claim 1, wherein the support body has an axial length approximately equal to that of a corresponding winding reel.

3. The reel winding device recited in claim 1, further comprising an adjustment mechanism for adjusting the height of the roll core mechanism.

4. The reel winding device recited in claim 1, wherein the roll core mechanism is stationary during a portion of the winding process.

5. The reel winding device recited in claim 4, wherein the support body further comprises a pressure roll arrangement.

6. The reel winding device recited in claim 5, wherein the pressure roll arrangement further comprises a plurality of pressure rollers arranged in succession in the axial direction.

7. The reel winding device recited in claim 6, wherein the pressure rollers are individually adjustable in relation to a common carrier.

8. The reel winding device recited in claim 1, further comprising said center drum and said winder drum arrangement being positioned to form at least two winding bed circumferentially spaced from each other with respect to said center drum, said winder drum arrangement comprising a plurality of support bodies, wherein said support bodies arranged in a same winding bed are axially spaced from each other to form a working space.

9. The reel winding device recited in claim 8, wherein the support bodies of one of said at least two winding beds are axially positioned along said center drum at positions which correspond to the working spaces of the other of the at least two winding beds.

10. The reel winding device recited in claim 1, wherein said reel core mechanism rotatably drives said at least one winding reel.

11. The reel winding device recited in claim 10, wherein said reel core mechanism rotatably drives said at least one winding reel while said reel core mechanism is inserted in the working space.

12. The reel winding device recited in claim 1, wherein said reel core mechanism comprises a plurality of reel core mechanisms, in which each at least one winding reel is coupled to two reel core mechanisms.

13. The reel winding device recited in claim 12, wherein at least one of said two reel core mechanisms coupled to each at least one winding reel rotatably drives said at least one winding reel.

14. The reel winding device recited in claim 13, wherein said at least one reel core mechanism rotatably drives said at least one winding reel while said at least one reel core is inserted in the working space.

15. A reel winding device comprising:

a center drum;

a winder drum arrangement;

said center drum and said winder drum arrangement defining at least one winding bed;

at least one winding roll received in said at least one winding bed;

a roll core mechanism coupled to each said at least one winding roll;

the winder drum arrangement having a support body for each said at least one winding roll;

the support bodies for each winding reel in said at least one winding bed are axially spaced from each other to form a free working space between axial ends of the support bodies;

the working space having an axial length sufficient to permit insertion of said roll core mechanism; and a support device for supporting the winder drum arrangement against gravitational forces.

16. The reel winding device recited in claim 15, wherein said support device is adjustable in the axial direction.

17. A reel winding device comprising:

a center drum;

a winder drum arrangement;

said center drum and said winder drum arrangement defining at least one winding bed;

at least one winding roll received in said at least one winding bed;

a roll core mechanism coupled to each said at least one winding roll;

the winder drum arrangement having a support body for each said at least one winding roll;

the support bodies for each winding reel in said at least one winding bed are axially spaced from each other to form a free working space between axial ends of the support bodies;

the working space having an axial length sufficient to permit insertion of said roll core mechanism, wherein the support body has an axial length approximately equal to that of a corresponding winding roll, and said support body comprises at least one disc.

18. The reel winding device recited in claim 17, wherein said at least one disc comprises a stack of discs which are connected to one another in a detachable manner.

19. The reel winding device recited in claim 18, wherein said discs have substantially the same axial length.

20. The reel winding device recited in claim 19, wherein the support body further comprises at least one disc of a radial thickness which is at least as great as the height of a winding head that carries the roll core mechanism.

21. The reel winding device recited in claim 20, wherein the support body is arranged along a shaft running parallel to an axial length of the center drum.

22. The reel winding device recited in claim 21, wherein said support body is connected to the shaft to give it torsional strength.

23. The reel winding device recited in claim 22, wherein said shaft is driven.

24. The reel winding device recited in claim 22, further comprising a roll outflow table, said support body being movable over said roll outflow table.

25. The reel winding device recited in claim 21, wherein said support body is adjustable axially along the shaft.

26. The reel winding device recited in claim 19, wherein said support body further comprises at least one compensating disc of an axial length which is less than that of the ones in the stack of discs.

27. The reel winding device recited in claim 18, wherein each disc includes an inflatable coating.

28. The reel winding device recited in claim 18, further comprising at least one movable carriage arrangement, said support body being carried on said movable carriage arrangement.

29. The reel winding device recited in claim 28, wherein the at least one movable carriage arrangement comprises a dedicated support roller mechanism.

30. The reel winding device recited in claim 28, wherein said at least one movable carriage arrangement comprises a separate movable carriage arrangement associated with each disc.

31. A reel winding device comprising:

a center drum;

a winder drum arrangement;

said center drum and said winder drum arrangement defining at least one winding bed;

at least one winding reel received in said at least one winding bed;

a roll core mechanism coupled to said at least one winding reel;

the winder drum arrangement comprising a support body for each winding reel, the support bodies for said at least one winding bed being axially spaced from each other to form a working space;

the support body further comprising a pressure roll arrangement, the pressure roll arrangement comprising a plurality of pressure rollers arranged in succession in the axial direction, the pressure rollers being individually adjustable in relation to a common carrier;

the working space being provided to permit insertion of said roll core mechanism;

a support device for supporting the winder drum arrangement against gravitational forces; and an adjustment mechanism for adjusting the height of the roll core mechanism.

32. A process for winding a material web on an apparatus that includes a center drum and a winder drum apparatus having support bodies, the process comprising:

adjusting axial lengths of the support bodies to correspond with axial lengths of winding rolls to be wound;

positioning at least one winding roll core in a winding bed formed by the center roll and the winder drum apparatus;

coupling a free end of a partial web to be wound onto each winding roll core; and rotating each winding roll core to form a partial web roll.

33. The process in accordance with claim 32, further comprising changing axial lengths of the support bodies to correspond with a different axial length winding roll to be wound.

34. The process in accordance with claim 32, further comprising positioning the support bodies to be axially spaced from each other to form working spaces between end faces of neighboring support bodies.

35. The process in accordance with claim 34, further comprising:

coupling a reel core mechanism to each at least one winding roll core;

inserting the reel core mechanism into the working spaces; and rotatably driving the at least one winding roll core with the reel core mechanism.

36. A process for winding a material web on an apparatus that includes a center drum and a winder drum apparatus having support bodies, the process comprising:

adjusting axial lengths of the support bodies to correspond with axial lengths of winding rolls to be wound;

positioning at least one winding roll core in a winding bed formed by the center roll and the winder drum apparatus;

coupling a free end of a partial web to be wound onto each winding roll core;

rotating each winding roll core to form a partial web roll; and changing axial lengths of the support bodies to correspond with a different axial length winding roll to be wound, wherein the support bodies are formed by at least one disk, and the changing of the axial lengths of the support bodies comprises one of adding disks to and removing disks from the support bodies.

37. A process for winding a material web on an apparatus that includes a center drum and a winder drum apparatus having support bodies, the process comprising:

adjusting axial lengths of the support bodies to correspond with axial lengths of winding rolls to be wound;

positioning at least one winding roll core in a winding bed formed by the center roll and the winder drum apparatus;

coupling a free end of a partial web to be wound onto each winding roll core; and rotating each winding roll core to form a partial web roll, wherein the support bodies are formed by at least one disk, and the adjusting of the axial lengths of the support bodies comprises one of adding disks to and removing disks from the support bodies.

38. A reel winding device comprising:

a center drum and a winding drum arrangement arranged to form at least one winding bed;

winding reels positionable in said at least one winding bed to form at least one wound roll; and said winding drum arrangement comprising support bodies, wherein a support body is associated with each of said winding reels in said at least one winding bed, wherein said support bodies are axially spaced from each other to form a working space.

39. The reel winding device in accordance with claim 38, further comprising at least one reel core drive coupled to each of said winding reels, wherein at least one said reel core drive is mounted for insertion into the working space.

40. The reel winding device in accordance with claim 38, wherein an axial length of each said support body corresponds to an axial length of the supported winding reel.

41. The reel winding device in accordance with claim 38, wherein said support bodies comprise at least one disc.

* * * * *